US009666149B2

(12) United States Patent
Kim et al.

(10) Patent No.: US 9,666,149 B2
(45) Date of Patent: May 30, 2017

(54) METHOD OF DRIVING DISPLAY PANEL AND DISPLAY APPARATUS FOR PERFORMING THE SAME

(71) Applicant: Samsung Display Co., Ltd., Yongin, Gyeonggi-Do (KR)

(72) Inventors: Mi-Suk Kim, Suwon-si (KR); Min-Hee Kim, Ansan-si (KR); Tae-Ho Kim, Asan-si (KR); Sung-Hwan Hong, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/676,634

(22) Filed: Apr. 1, 2015

(65) Prior Publication Data

US 2016/0140890 A1 May 19, 2016

(30) Foreign Application Priority Data

Nov. 14, 2014 (KR) ..... 10-2014-0159148

(51) Int. Cl.
*G09G 3/36* (2006.01)

(52) U.S. Cl.
CPC ... *G09G 3/3614* (2013.01); *G09G 2300/0434* (2013.01); *G09G 2320/0238* (2013.01); *G09G 2320/0247* (2013.01); *G09G 2320/0257* (2013.01)

(58) Field of Classification Search
None
See application file for complete search history.

(56) References Cited

U.S. PATENT DOCUMENTS

2006/0152462 A1* 7/2006 Furihata ..... G09G 3/3655 345/98
2012/0105510 A1* 5/2012 Nakanishi ..... G09G 3/3655 345/690
2012/0127148 A1* 5/2012 Lee ..... G02F 1/134363 345/212
2015/0154930 A1* 6/2015 Woo ..... G09G 5/10 345/691
2016/0075947 A1* 3/2016 Sudo ..... C09K 19/3001 252/299.63

FOREIGN PATENT DOCUMENTS

KR 2000-0040118 A 7/2000
KR 10-2006-0135180 A 12/2006
KR 10-2007-0028021 A 3/2007

* cited by examiner

*Primary Examiner* — Joseph Haley
(74) *Attorney, Agent, or Firm* — Lewis Roca Rothgerber Christie LLP

(57) ABSTRACT

A method of driving a display panel, the method including generating a data signal including a black voltage signal and a white voltage signal, measuring brightness levels of pixels, converting differences between the measured brightness levels into direct current (DC) voltages, resetting the black voltage signal to reduce a difference between the DC voltages, generating a data voltage based on the data signal to output the data voltage to the display panel, and displaying an image on the display panel based on the data voltage.

20 Claims, 9 Drawing Sheets

METHOD OF DRIVING DISPLAY PANEL AND DISPLAY APPARATUS FOR PERFORMING THE SAME

CROSS-REFERENCE TO RELATED APPLICATION

This application claims priority to and the benefit of Korean Patent Application No. 10-2014-0159148, filed on Nov. 14, 2014 in the Korean Intellectual Property Office (KIPO), the entire content of which is herein incorporated by reference.

BACKGROUND

1. Field

Example embodiments relate generally to methods of driving a display panel, and more particularly to methods of driving a liquid crystal display panel and apparatuses for driving the liquid crystal display panel.

2. Description of the Related Art

A liquid crystal display ("LCD") apparatus is a kind of flat display apparatuses, which is now used broadly. The LCD apparatus applies voltages to molecules of a liquid crystal to adjust arrangements of the molecules thereby changing optical characteristics of liquid crystal cells, such as birefringence, optical activity, dichroism and light scattering to display an image.

In the LCD apparatus, a liquid crystal is disposed between an array substrate on which a pixel electrode is formed and a color filter substrate on which a common electrode is formed. Transmittance of a pixel is adjusted by alignment of the liquid crystal, which is changed by an electric field between the pixel electrode and the common electrode such that an image is displayed on the LCD apparatus.

Recently, in order to solve low side visibility problem of a conventional LCD apparatus, LCD apparatuses, having a patterned vertical alignment ("PVA") mode, an in-plane switching ("IPS") mode, etc., are developed. However, a LCD apparatus having a PVA mode has afterimage defects and a limited side viewing angle, and a LCD apparatus having an IPS mode has a disadvantage that luminance of a displayed image is low. In order to solve these disadvantages, a LCD apparatus having a plane to line switching ("PLS") mode is developed.

The LCD apparatus having the PLS mode includes a liquid crystal. The liquid crystal may be a positive-type (positive kind) liquid crystal or a negative-type (negative kind) crystal. Because a splay angle of the positive-type liquid crystal is greater than a splay angle of the negative-type liquid crystal, transmittances of a central portion of the pixel electrode having a slit pattern and a central portion of the slit pattern are low in the LCD apparatus including the positive-type liquid crystal. Alternatively, because the splay angle of the negative-type liquid crystal is less than the splay angle of the positive-type liquid crystal, transmittance of the LCD apparatus including the negative-type liquid crystal is greater than transmittance of the LCD apparatus including the positive-type liquid crystal.

The LCD apparatus including the negative-type liquid crystal and having the PLS mode includes an alignment layer, and an alignment direction of the alignment layer is substantially perpendicular to a direction of a pixel electrode pattern. Ionic impurities in the negative-type liquid crystal are more than ionic impurities in the positive-type liquid crystal. In the LCD apparatus including the negative-type liquid crystal, the ionic impurities may be attached to the alignment layer by a thermal fluctuation of the liquid crystal, and a luminance difference and an afterimage between images may occur.

If a pattern is displayed for a long time in the LCD apparatus, the pattern may remain on the display panel when another image is displayed on the display panel. The remaining pattern is called to an afterimage. A major reason causing the afterimage is a residual DC voltage generally generated by discordance between an electric center of a data voltage and a common voltage.

In an LCD apparatus having a plane to switching ("PLS") mode, the voltage-time curve (V-T curve) in a positive polarity and V-T curve in a negative polarity do not coincide with each other so that the discordance between the electric center of a data voltage and a common voltage may naturally occur. Thus, the afterimage problem may be serious in the LCD apparatus having the PLS mode compared to the LCD apparatuses having the twisted nematic (TN) mode and the vertically aligned (VA) mode.

SUMMARY

Accordingly, the inventive concept is provided to substantially obviate one or more problems due to limitations and disadvantages of the related art.

Aspects of one or more embodiments are directed toward a method of driving a display panel capable of improving a display quality by preventing or substantially preventing an afterimage.

Aspects of one or more embodiments are directed toward a display apparatus for performing the method of driving the display panel.

According to one or more example embodiments, there is provided a method of driving a display panel, the method including: generating a data signal including a black voltage signal and a white voltage signal; measuring brightness levels of pixels; converting differences between the measured brightness levels into direct current (DC) voltages; resetting the black voltage signal to reduce (e.g., minimize) a difference between the DC voltages; generating a data voltage based on the data signal to output the data voltage to the display panel; and displaying an image on the display panel based on the data voltage.

In an embodiment, the method further includes: generating a common voltage to output the common voltage to the display panel.

In an embodiment, when the common voltage is output to the display panel, residual DC voltages are accumulated at pixel electrodes of the display panel.

In an embodiment, a first residual DC voltage of a first pixel of the pixels to which the white voltage signal is applied is greater than a second residual DC voltage of a second pixel of the pixels to which the black voltage signal is applied.

In an embodiment, a difference between the first residual DC voltage and the second residual DC voltage is in a range of about 45 mV to about 90 mV.

In an embodiment, the black voltage signal is reset based on a black offset, the black offset being in a range of about 45 mV to about 90 mV.

In an embodiment, the reset black voltage signal includes a positive polarity frame and a negative polarity frame, and wherein the positive polarity frame and the negative polarity frame are asymmetric.

In an embodiment, the display panel includes: a first substrate; a common electrode on the first substrate; a pixel electrode on the common electrode, the pixel electrode overlapping the common electrode; a second substrate facing the first substrate; and a liquid crystal layer between the first and second substrates.

In an embodiment, the method further includes: a first alignment layer on the first substrate; and a second alignment layer on the second substrate.

In an embodiment, the first and second alignment layers are photoalignment layers.

In an embodiment, the liquid crystal layer includes a liquid crystal having negative dielectric anisotropy.

In an embodiment, the liquid crystal layer further includes hindered amine light stabilizer (HALS).

According to one or more example embodiments, there is provided a display apparatus including: a timing controller configured to generate a data signal; a data driver configured to generate a data voltage based on the data signal and to output the data voltage; and a display panel configured to display an image based on the data voltage, wherein the timing controller including: a data signal generator configured to generate the data signal including a black voltage signal and a white voltage signal; a flicker detector configured to measure brightness levels of pixels; a flicker quantification part configured to convert differences between the measured brightness levels into direct current (DC) voltages; and a black voltage signal controller configured to reset the black voltage signal to reduce (e.g., minimize) a difference between the DC voltages.

In an embodiment, a difference between a first residual DC voltage of a first pixel to which the white voltage signal is applied and a second residual DC voltage of a second pixel to which the black voltage signal is applied is in a range of about 45 mV to about 90 mV.

In an embodiment, the black voltage signal is reset based on a black offset, the black offset being in a range of about 45 mV to about 90 mV.

In an embodiment, the display panel includes: a first substrate; a common electrode on the first substrate; a pixel electrode on the common electrode, the pixel electrode overlapping the common electrode; a second substrate facing the first substrate; and a liquid crystal layer between the first and second substrates.

In an embodiment, the display apparatus further includes: a first alignment layer on the first substrate; and a second alignment layer on the second substrate.

In an embodiment, the first and second alignment layers are photoalignment layers.

In an embodiment, the liquid crystal layer includes a liquid crystal having negative dielectric anisotropy.

In an embodiment, the liquid crystal layer further includes hindered amine light stabilizer (HALS).

According to a method of driving a display panel and a display apparatus for performing the method of driving the display panel in one or more embodiments, a black voltage signal is reset based on a difference between brightness levels of pixels to which data voltage signals different from each other are applied to reduce (e.g., to minimize) a direct voltage difference between the black voltage signal and a white voltage signal. As such, afterimage is prevented or substantially prevented and a display quality of the display panel is improved.

BRIEF DESCRIPTION OF THE DRAWINGS

Illustrative, non-limiting, example embodiments will be more clearly understood from the following detailed description taken in conjunction with the accompanying drawings.

DETAILED DESCRIPTION

Figure 1:
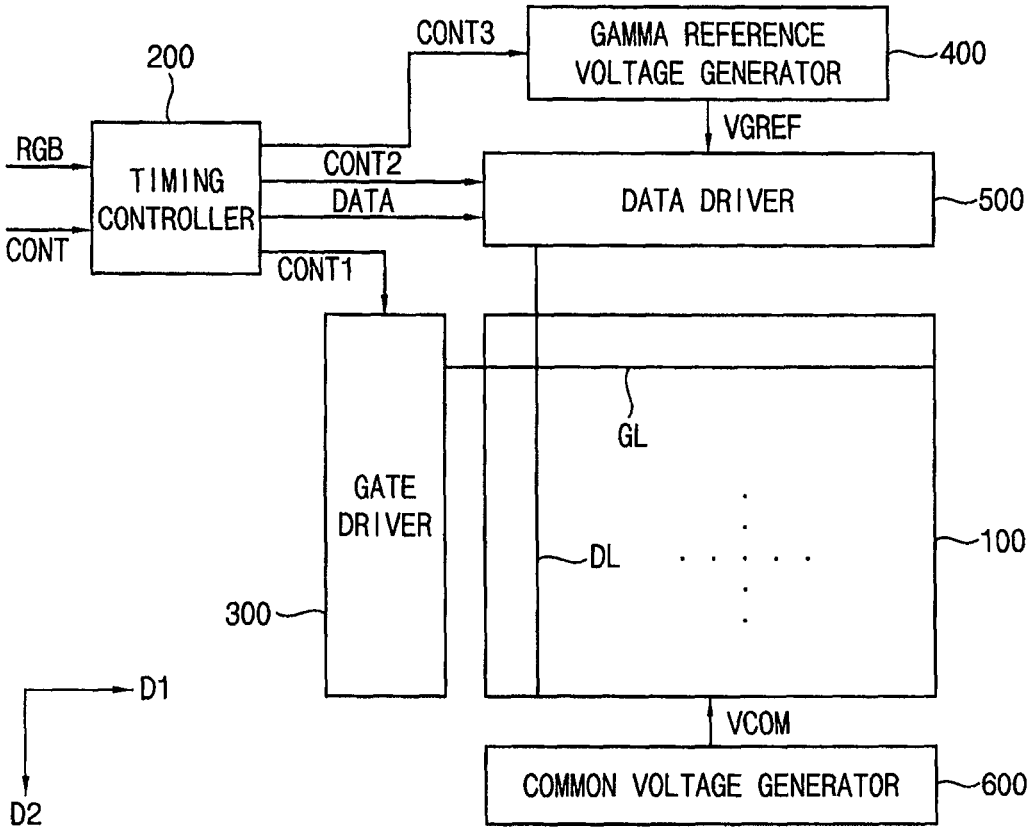
FIG. 1 is a block diagram illustrating a display apparatus according to an example embodiment of the inventive concept.

Various example embodiments will be described more fully with reference to the accompanying drawings, in which various embodiments are shown. The present inventive concept may, however, be embodied in many different forms and should not be construed as limited to the embodiments set forth herein. Rather, these embodiments are provided so that this disclosure will be thorough and complete, and will fully convey the scope of the inventive concept to those skilled in the art. Like reference numerals refer to like elements throughout this application.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. When an element or layer is referred to as being "directly on," "directly connected to", "directly coupled to", or "immediately adjacent to" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

Also, any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such subranges would comply with the requirements of 35 U.S.C. §112, first paragraph, and 35 U.S.C. §132(a).

The display apparatus and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display apparatus may be formed on one integrated circuit (IC) chip or on separate IC chips. Further, the various components of the display apparatus may be implemented on a flexible printed circuit film, a tape carrier package (TCP), a printed circuit board (PCB), or formed on a same substrate as the display apparatus. Further, the various components of the display apparatus may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention. Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating a display apparatus according to an example embodiment of the inventive concept.

Referring to FIG. 1, the display apparatus includes a display panel 100 and a panel driver. The panel driver includes a timing controller 200, a gate driver 300, a gamma reference voltage generator 400, a data driver 500, and a common voltage generator 600.

The display panel 100 may have a display region on which an image is displayed and a peripheral region adjacent to the display region.

The display panel 100 may include a plurality of gate lines GL, a plurality of data lines DL, and a plurality of unit pixels connected to the gate lines GL and the data lines DL. The gate lines GL may extend along a first direction D1 and the data lines DL may extend along a second direction D2 crossing the first direction D1.

Each unit pixel may include a switching element, a liquid crystal capacitor, and a storage capacitor. The liquid crystal capacitor and the storage capacitor may be electrically connected to the switching element. The unit pixels may be arranged in a matrix form.

The timing controller 200 may receive input image data RGB and an input control signal CONT from an external apparatus. The input image data may include red image data R, green image data G, and blue image data B. The input control signal CONT may include a master clock signal and a data enable signal. The input control signal CONT may further include a vertical synchronizing signal and a horizontal synchronizing signal.

The timing controller 200 may generate a first control signal CONT1, a second control signal CONT2, a third control signal CONT3, and a data signal DATA based on the input image data RGB and the input control signal CONT.

The timing controller 200 may generate the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The timing controller 200 may generate the second control signal CONT2 for controlling an operation of the data driver 500 based on the input control signal CONT, and may output the second control signal CONT2 to the data driver 500. The second control signal CONT2 may include a horizontal start signal and a load signal.

The timing controller 200 may generate the data signal DATA based on the input image data RGB. The timing controller 200 may output the data signal DATA to the data driver 500.

The timing controller 200 may generate the third control signal CONT3 for controlling an operation of the gamma reference voltage generator 400 based on the input control signal CONT, and may output the third control signal CONT3 to the gamma reference voltage generator 400.

The gate driver 300 may generate gate signals driving the gate lines GL in response to the first control signal CONT1 received from the timing controller 200. The gate driver 300 may sequentially output the gate signals to the gate lines GL.

The gate driver 300 may be directly mounted on the display panel 100, or may be connected to the display panel 100 with a tape carrier package (TCP). Alternatively, the gate driver 300 may be integrated on the display panel 100.

The gamma reference voltage generator 400 may generate a gamma reference voltage VGREF in response to the third control signal CONT3 received from the timing controller 200. The gamma reference voltage generator 400 may provide the gamma reference voltage VGREF to the data driver 500. The gamma reference voltage VGREF may have a value corresponding to a level of the data signal DATA.

In an exemplary embodiment, the gamma reference voltage generator 400 may be disposed in the timing controller 200, or in the data driver 500.

The data driver 500 may receive the second control signal CONT2 and the data signal DATA from the timing controller 200, and may receive the gamma reference voltages VGREF from the gamma reference voltage generator 400. The data driver 500 may convert the data signal DATA into analog data voltages (i.e., data voltages having analog values) using the gamma reference voltages VGREF. The data driver 500 may output the data voltages to the data lines DL.

The data driver 500 may be directly mounted on the display panel 100, or be connected to the display panel 100 with a TCP. Alternatively, the data driver 500 may be integrated on the display panel 100.

The common voltage generator 600 may generate a common voltage VCOM. The common voltage generator 600 may output the first common voltage VCOM to the display panel 100.

Figure 2:
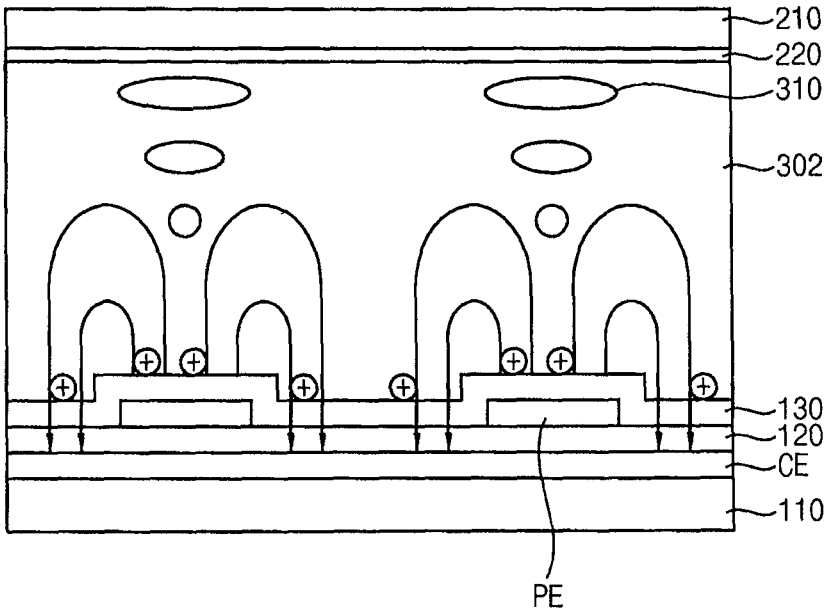
FIG. 2 is a cross-sectional view illustrating a display panel according to an example embodiment.

FIG. 2 is a cross-sectional view illustrating a display panel according to an example embodiment.

Referring to FIG. 2, the display panel 100 includes a first substrate 110, a second substrate 210 and a liquid crystal layer 302.

The first substrate 110 may be a transparent substrate that includes insulation material. For example, the first substrate 110 may be a glass substrate or a transparent plastic substrate. The first substrate 110 may include a plurality of pixel areas for displaying an image. The plurality of pixel areas may be arranged in a matrix form.

A common electrode CE may be disposed on the first substrate 110. A common voltage may be applied to the common electrode CE.

For example, the common electrode CE may include one or more transparent conductive materials, such as indium tin oxide (ITO), indium zinc oxide (IZO), aluminum zinc oxide (AZO), and/or the like.

A passivation layer 120 may be disposed on the common electrode CE.

The passivation layer 120 may include inorganic insulation material. For example, the passivation layer 120 may include silicon oxide ($SiO_X$) or silicon nitride ($SiN_X$).

A pixel electrode PE may be disposed on the passivation layer 120. A grayscale voltage may be applied to the pixel electrode PE. The pixel electrode PE may overlap the common electrode CE.

For example, the pixel electrode PE may include at least one transparent conductive material selected from the group consisting of indium tin oxide (ITO), indium zinc oxide (IZO), and aluminum zinc oxide (AZO).

For example, the pixel electrode PE may have a slit pattern.

The pixel electrode PE may overlap the common electrode CE. A fringe field may be formed in the liquid crystal layer 302 between the pixel electrode PE to which the grayscale voltage is applied and the common electrode CE to which the common voltage is applied. Accordingly, the display panel may operate in PLS mode.

A first alignment layer 130 may be disposed on the pixel electrode PE.

For example, the first alignment layer 130 may be a photoalignment layer. The photoalignment layer may include polyimide compound formed by photo-polymerization of dianhydride, diamine, etc. For example, the photoalignment layer may be rearranged by isomerization or decomposition through an exposure process.

A second alignment layer 220 may be disposed on the second substrate 210.

For example, the second alignment layer 220 may be a photoalignment layer. The photoalignment layer may include polyimide compound formed by photo-polymerization of dianhydride, diamine, etc. For example, the photoalignment layer may be rearranged by isomerization or decomposition through an exposure process.

The liquid crystal layer 302 may be disposed between the first substrate 110 and the second substrate 210.

The liquid crystal layer 302 may include a liquid crystal. For example, the liquid crystal may be a negative-type liquid crystal.

The liquid crystal may be a positive-type liquid crystal or a negative-type crystal. Because a splay angle of the positive-type liquid crystal is greater than a splay angle of the negative-type liquid crystal, in the LCD apparatus including the positive-type liquid crystal, transmittances of a central portion of the pixel electrode having a slit pattern and a central portion of the slit pattern are low. Alternatively, because the splay angle of the negative-type liquid crystal is less than the splay angle of the positive-type liquid crystal, transmittance of the LCD apparatus including the negative-type liquid crystal is greater than transmittance of the LCD apparatus including the positive-type liquid crystal.

For example, the liquid crystal layer 302 may further include hindered amine light stabilizer (HALS). The HALS may effectively prevent a line afterimage in the display panel 100. For example, the HALS in a range of about 100 ppm to about 1000 ppm for the total weight of the liquid crystal may be included.

For example, the liquid crystal layer 302 may further include antioxidants. For example, the antioxidants may include dibutyl hydroxyl toluene (BHT). For example, the BHT in a range of about 100 ppm to about 1000 ppm for the total weight of the liquid crystal may be included.

Figure 3:
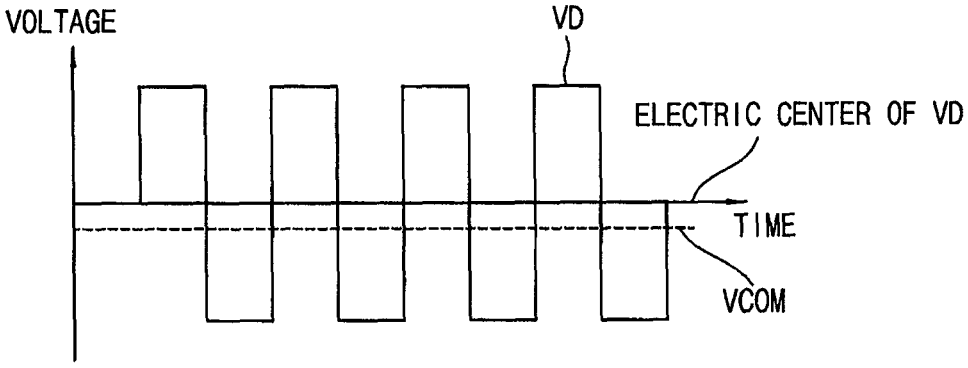
FIG. 3 is a waveform diagram illustrating a data voltage and a common voltage to explain a residual DC voltage accumulated in a display panel.

FIG. 3 is a waveform diagram illustrating a data voltage and a common voltage to explain a residual DC voltage accumulated in a display panel.

Referring to FIG. 3, the data voltage VD is applied to the pixel electrode of the first substrate 110. The common voltage VCOM is applied to the common electrode.

The electric center of the data voltage VD is not equal to the common voltage VCOM. There may be various reasons causing discordance of the electric center of the data voltage VD and the common voltage VCOM. For example, the electric center of the data voltage VD may not be equal to the common voltage VCOM due to variations in the manufacturing process. In addition, the electric center of the data voltage VD may not be equal to the common voltage VCOM due to discordance between the voltage-time curve (V-T curve) in a positive polarity and the V-T curve in a negative polarity. In addition, the electric center of the data Voltage VD may not be equal to the common voltage VCOM due to deviation of a kickback voltage according to positions in the display panel 100.

Figure 4A:
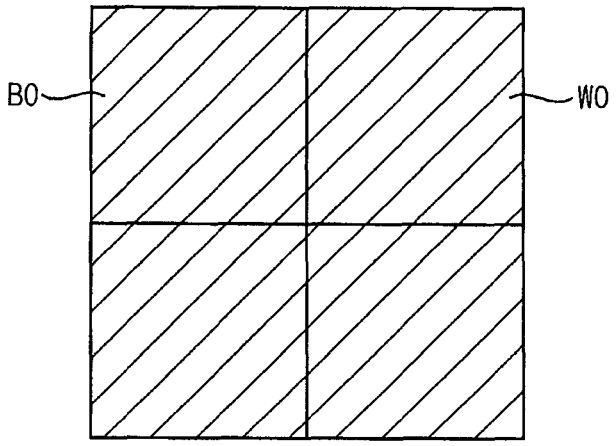
FIGS. 4A to 4C are plan views illustrating 2×2 pixels in the display panel.
Figure 4B:
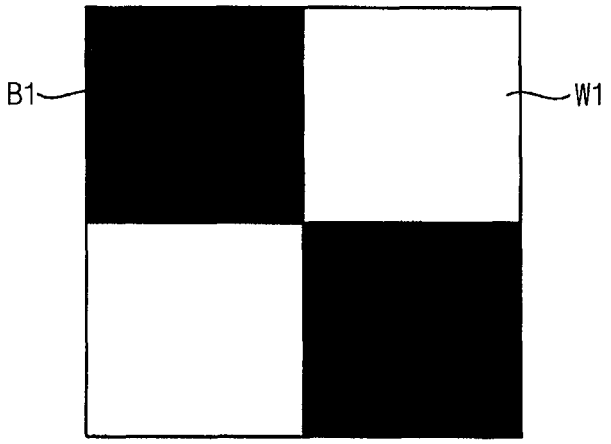
Figure 4C:
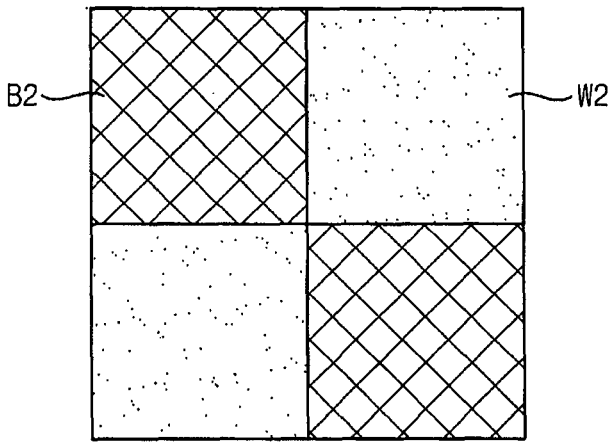
Figure 5A:
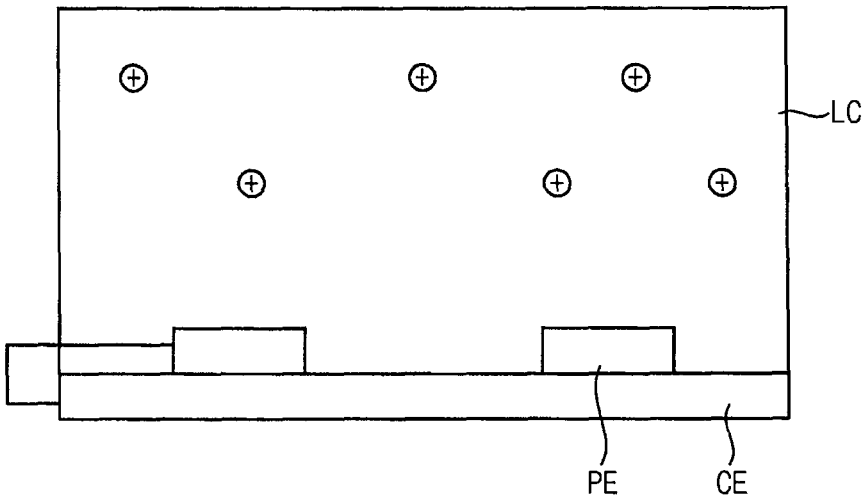
FIGS. 5A to 5C are conceptual diagrams to explain a first residual DC voltage of a first pixel accumulated in the display panel.
Figure 5B:
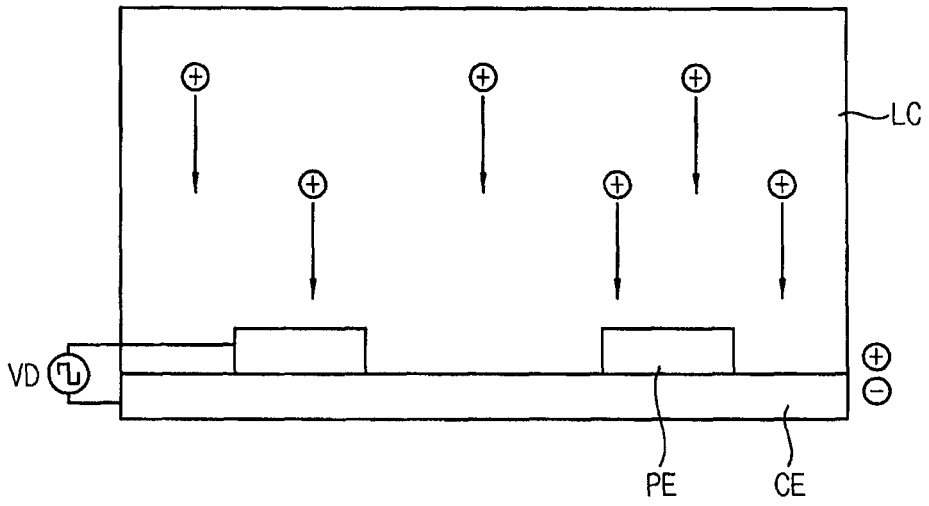
Figure 5C:
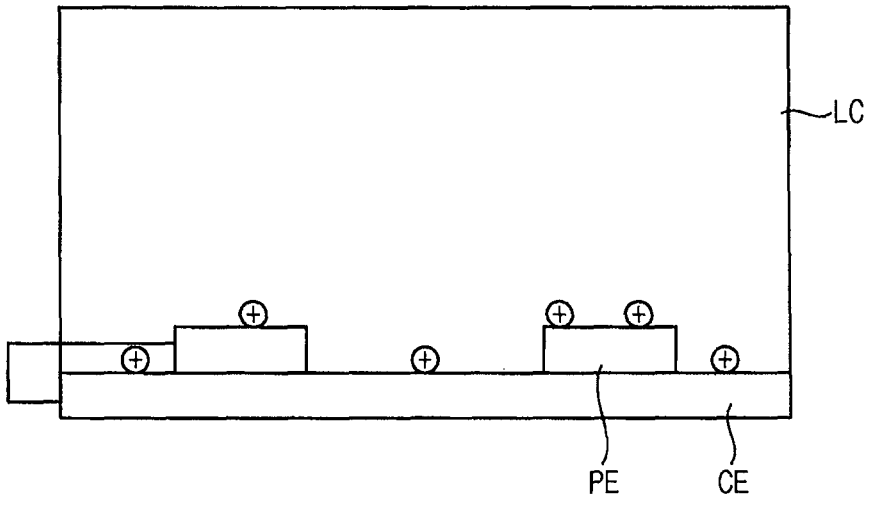
Figure 6A:
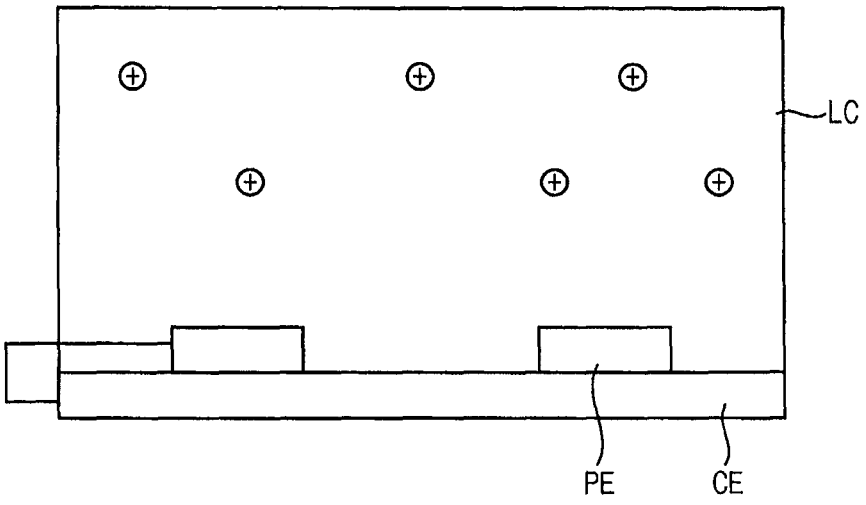
FIGS. 6A to 6C are conceptual diagrams to explain a second residual DC voltage of a second pixel accumulated in the display panel.
Figure 6B:
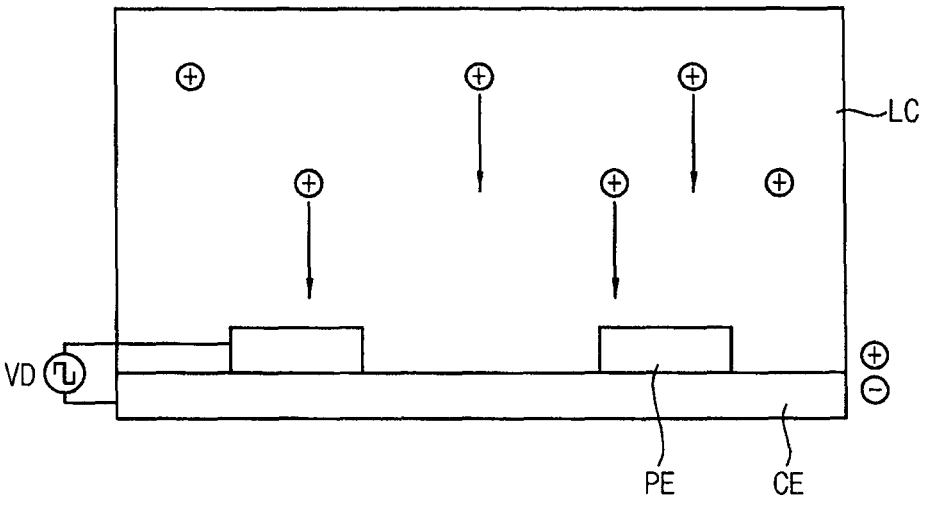
Figure 6C:
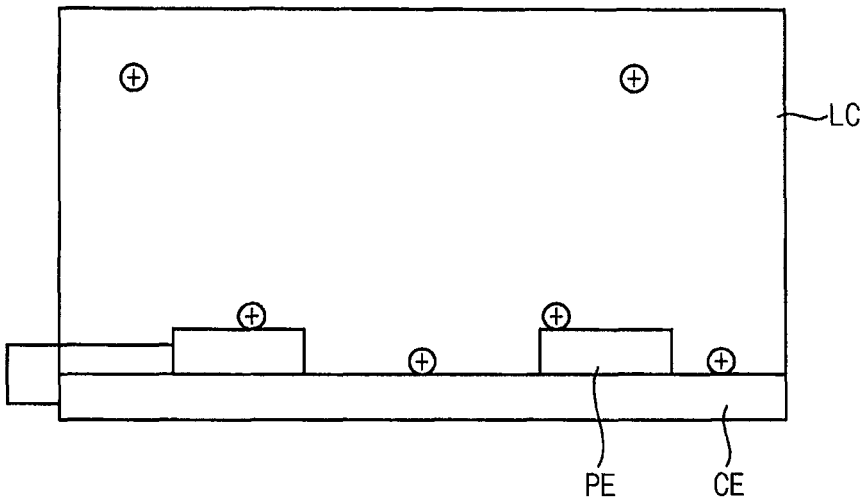

FIGS. 4A to 4C are plan views illustrating 2×2 pixels in the display panel. FIGS. 5A to 5C are conceptual diagrams to explain a first residual DC voltage of a first pixel accumulated in the display panel. FIGS. 6A to 6C are conceptual diagrams to explain a second residual DC voltage of a second pixel accumulated in the display panel.

Referring to FIG. 4A, voltages are not applied to a common electrode CE and a pixel electrode PE in a respective pixel. A pattern may not be displayed in pixels B0 and W0 adjacent to each other, and the pixels B0 and W0 may have the same luminance.

Referring to FIG. 4B, voltages are applied to the common electrode CE and the pixel electrode PE in the respective pixel to display an image like a checker board. For example, data voltages different from each other may be applied to pixels B1 and W1 adjacent to each other. The data voltages may include a "black voltage" to display a black color and a "white voltage" to display a white color. The black voltage may be applied to the pixel B1 to display the black color, and the white voltage may be applied to the pixel W1 to display the white color. The black voltage may be less than the white voltage. Accordingly, holes (+) moved by the white voltage in the pixel W1 may be more than holes (+) moved by the black voltage in the pixel B1.

The electric center of the data voltage VD is higher than the common voltage VCOM so that the first substrate has a voltage that has, on average, a positive polarity and the second substrate has a voltage that has, on average, a negative polarity. Thus, the holes (+) are displaced toward the first alignment layer 130. When the data voltage VD is applied to the first substrate 110 for a relatively long time, the holes (+) are completely displaced to the first alignment layer 130.

Referring to FIG. 4C, voltages are applied to the common electrode CE and the pixel electrode PE. However, the holes (+) are already completely displaced to the first alignment layer 130 due to the data voltage including the black voltage signal and the white voltage signal in FIG. 4B.

The residual DC voltage is continuously accumulated in the pixel of the display panel 100 as time passes. Thus, the residual DC voltage is saturated in the pixel of the display panel 100. Due to the residual DC voltage, a positive data voltage applied to the pixel may represent a luminance less than a corresponding grayscale.

Levels of the residual DC voltages may vary according to the pixels of the display panel 100. For example, a first residual DC voltage of a first pixel W2 (to which the white voltage signal, a relatively high grayscale voltage, is applied) is greater than a second residual DC voltage of a second pixel B2 (to which the black voltage signal, a relatively low grayscale voltage, is applied).

The first residual DC voltage accumulated at the first pixel displaying a white grayscale is very high. In contrast, the second residual DC voltage accumulated at a second pixel displaying a black grayscale is very low. Thus, when a single grayscale image is applied after a checker board pattern, which alternately includes white and black pixels, is applied to the display panel 100 for a long time, the second pixel which was displaying black represents a luminance different from a luminance of the first pixel which was displaying white. Therefore, the afterimage is generated due to the difference of luminance between the first and second pixels.

Referring to FIGS. 5A to 5C, when the white voltage signal is not applied to the first pixel, the holes (+) are uniformly distributed in the liquid crystal layer LC.

When the white voltage signal is applied to the first pixel, relatively more holes (+) may be displaced to the first alignment layer 130. The first residual voltage accumulated in the first pixel may be high.

Referring to FIGS. 6A to 6C, when the black voltage signal is not applied to the second pixel, the holes (+) are uniformly distributed in the liquid crystal layer LC.

When the black voltage signal is applied to the second pixel, relatively less holes (+) may be displaced to the first alignment layer 130. The second residual voltage accumulated in the second pixel may be low.

Figure 7:
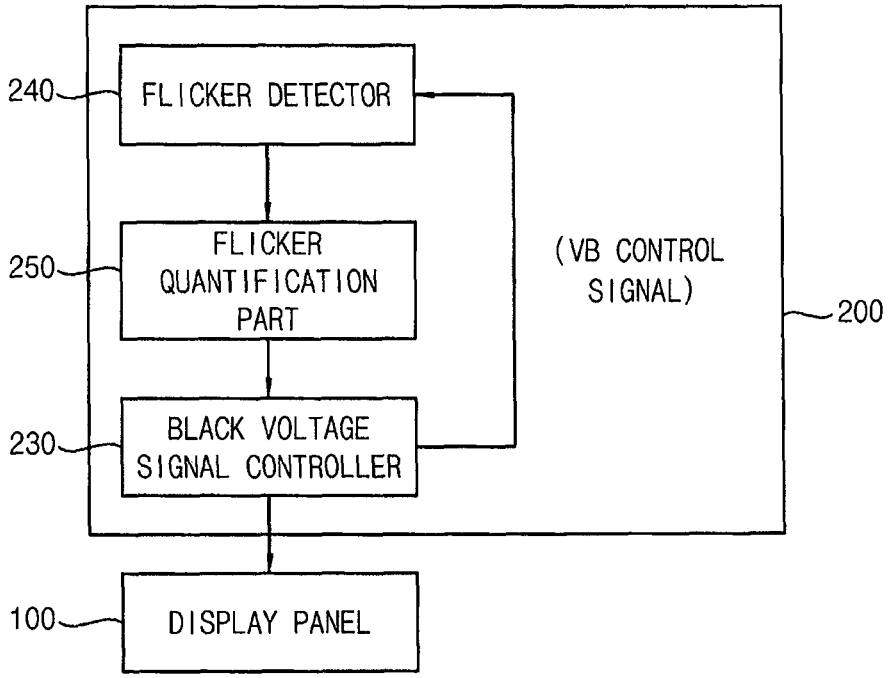
FIG. 7 is a block diagram illustrating the timing controller and the display panel in FIG. 1.

FIG. 7 is a block diagram illustrating the timing controller and the display panel in a display apparatus of FIG. 1.

Referring to FIGS. 1 and 7, the display apparatus includes a display panel 100 and a panel driver. The panel driver includes a timing controller 200, a gate driver 300, a gamma reference voltage generator 400, a data driver 500, and a common voltage generator 600.

The timing controller 200 generates the data signal DATA. The data driver 500 generates a data voltage based on the data signal received from the timing controller 200. The display panel 100 displays an image based on the data voltage received from the data driver 500.

The timing controller 200 may include a data signal generator, a flicker detector 240, a flicker quantification part 250, and a black voltage signal controller 230.

The data signal generator generates the data signal. The data signal may include a black voltage signal and a white voltage signal.

The flicker detector 240 measures brightness levels of pixels.

The flicker detector 240 may continuously output a pattern of a specific grayscale level to measure the brightness levels of the pixels in a scan region. For example, the flicker detector 240 may output a pattern of a black grayscale level based on the black voltage signal to a first region and may output a pattern of a white grayscale level based on the white voltage signal to a second region which is adjacent to the first region.

The flicker quantification part 250 converts differences between the measured brightness levels into direct current (DC) voltages.

A first residual voltage of a first pixel to which a white voltage signal is applied may be greater than a second residual voltage of a second pixel to which a black voltage signal is applied. For example, a difference between the first residual voltage and the second residual voltage may be in a range of about 45 mV to about 90 mV.

The black voltage signal controller 230 may reset the black voltage signal to reduce (e.g., to minimize) the difference between the first residual voltage and the second residual voltage.

For example, the black voltage signal is reset based on a black offset which is in a range of about 45 mV to about 90 mV. If the black offset is less than about 45 mV, an afterimage may occur in the pixels to which the white voltage signal and the black voltage signal are applied. If the black offset is more than about 90 mV, an afterimage may occur in the pixels to which the white voltage signal and the black voltage signal are applied.

The reset black voltage signal may include a positive polarity frame and a negative polarity frame, and the positive polarity frame and the negative polarity frame may be asymmetric.

Figure 8:
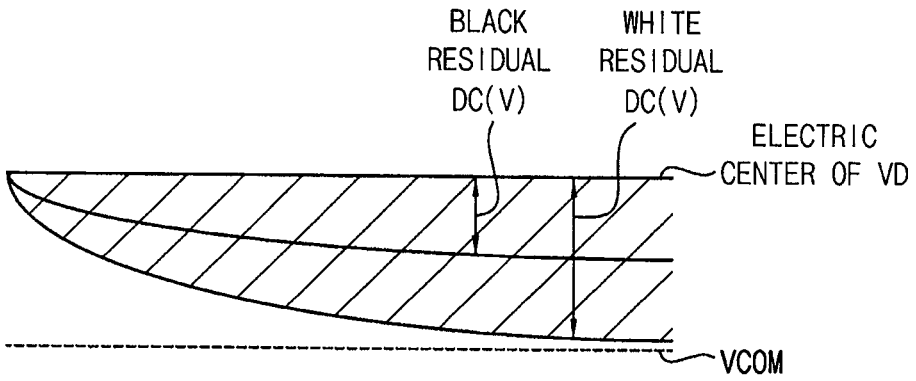
FIG. 8 is a waveform diagram illustrating first and second residual DC voltages accumulated in the display panel.
Figure 9:
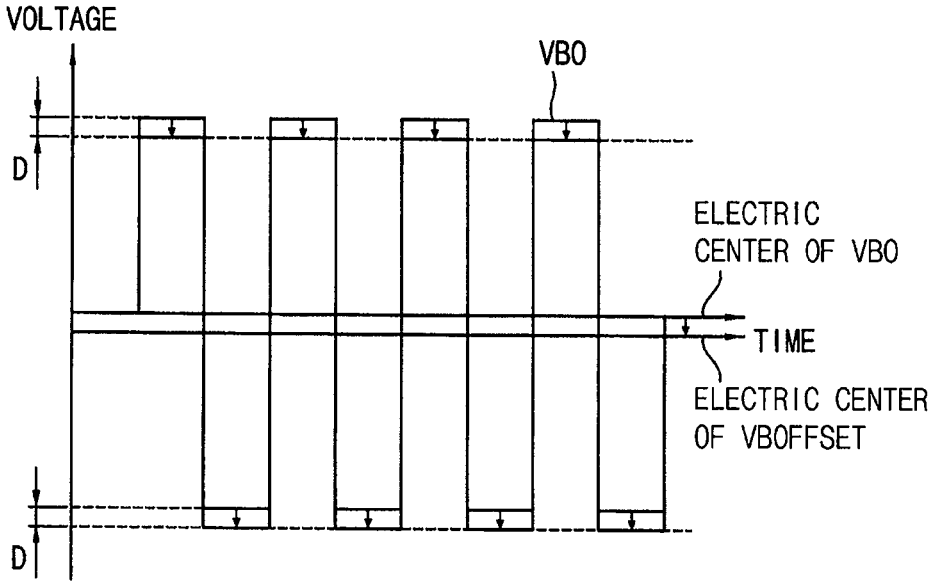
FIG. 9 is a waveform diagram illustrating that a black voltage signal is reset based on a black offset.

FIG. 8 is a waveform diagram illustrating first and second residual DC voltages accumulated in the display panel. FIG. 9 is a waveform diagram illustrating that a black voltage signal is reset based on a black offset.

Referring to FIGS. 8 and 9, levels of the residual DC voltages may vary according to the pixels of the display panel 100.

The first residual DC voltage accumulated at the first pixel displaying a white grayscale is very high. In contrast, the second residual DC voltage accumulated at a second pixel displaying a black grayscale is very low. Thus, when a single grayscale image is applied after a checker board pattern, which alternately includes white and black pixels, is applied to the display panel 100 for a long time, the second pixel which was displaying black represents a luminance different from a luminance of the first pixel which was displaying white. Therefore, the afterimage is generated due to the difference of luminance between the first and second pixels, and the afterimage may be reduced by reducing (e.g., minimizing) the difference of luminance between the first and second pixels.

The first residual DC voltage of the first pixel (to which the white voltage signal, the relatively high grayscale voltage, is applied) is greater than the second residual DC voltage of the second pixel (to which the black voltage signal, the relatively low grayscale voltage, is applied). For example, a difference between the first residual voltage and the second residual voltage may be in a range of about 45 mV to about 90 mV.

The black voltage signal controller 230 may reset the black voltage signal to reduce (e.g., to minimize) the difference between the first residual voltage and the second residual voltage.

As illustrated in FIG. 9, for example, the black voltage signal is reset based on a black offset which is in a range of about 45 mV to about 90 mV. Accordingly, the electric center of the reset black voltage signal VBoffset may be closer to the electric center of the white voltage signal than the electric center of the black voltage signal before reset.

The reset black voltage signal VBoffset may include a positive polarity frame and a negative polarity frame, and the positive polarity frame and the negative polarity frame may be asymmetric.

The foregoing is illustrative of example embodiments and is not to be construed as limiting thereof. Although a few example embodiments have been described, those skilled in the art will readily appreciate that many suitable modifications are possible in the example embodiments without materially departing from the novel teachings and aspects of the present inventive concept. Accordingly, all such modifications are intended to be included within the scope of the present inventive concept as defined in the claims, and equivalents thereof. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and equivalents thereof.

What is claimed is:

1. A method of driving a display panel, the method comprising:

generating a data signal comprising a black voltage signal and a white voltage signal;

measuring brightness levels of each of a plurality of pixels;

converting differences between the measured brightness levels into direct current (DC) voltages comprising a first residual DC voltage of a first pixel of the pixels to which the white voltage signal is applied, and a second residual DC voltage of a second pixel of the pixels to which the black voltage signal is applied;

resetting the black voltage signal to reduce a difference between the first and second residual DC voltages;

generating a data voltage based on the data signal to output the data voltage to the display panel; and displaying an image on the display panel based on the data voltage.

2. The method of claim 1, further comprising:

generating a common voltage to output the common voltage to the display panel.

3. The method of claim 2, wherein when the common voltage is output to the display panel, residual DC voltages are accumulated at pixel electrodes of the display panel.

4. The method of claim 3, wherein the first residual DC voltage is greater than the second residual DC voltage.

5. The method of claim 4, wherein a difference between the first residual DC voltage and the second residual DC voltage is in a range of about 45 mV to about 90 mV.

6. The method of claim 5, wherein the black voltage signal is reset based on a black offset, the black offset being in a range of about 45 mV to about 90 mV.

7. The method of claim 1, wherein the reset black voltage signal comprises a positive polarity frame and a negative polarity frame, and wherein the positive polarity frame and the negative polarity frame are asymmetric.

8. The method of claim 1, wherein the display panel comprises:

a first substrate;

a common electrode on the first substrate;

a pixel electrode on the common electrode, the pixel electrode overlapping the common electrode;

a second substrate facing the first substrate; and a liquid crystal layer between the first and second substrates.

9. The method of claim 8, further comprising:

a first alignment layer on the first substrate; and a second alignment layer on the second substrate.

10. The method of claim 9, wherein the first and second alignment layers are photoalignment layers.

11. The method of claim 8, wherein the liquid crystal layer comprises a liquid crystal having negative dielectric anisotropy.

12. The method of claim 11, wherein the liquid crystal layer further comprises hindered amine light stabilizer (HALS).

13. A display apparatus comprising:

a timing controller configured to generate a data signal;

a data driver configured to generate a data voltage based on the data signal and to output the data voltage; and a display panel configure d to display an image based on the data voltage, wherein the timing controller comprising:

a data signal generator configured to generate the data signal comprising a black voltage signal and a white voltage signal;

a flicker detector configured to measure brightness levels of each of a plurality of pixels;

a flicker quantification part configured to convert differences between the measured brightness levels into direct current (DC) voltages comprising a first residual DC voltage of a first pixel of the pixels to which the white voltage signal is applied, and a second residual DC voltage of a second pixel of the pixels to which the black voltage signal is applied; and a black voltage signal controller configured to reset the black voltage signal to reduce a difference between the first and second residual DC voltages.

14. The display apparatus of claim 13, wherein a difference between the first residual DC voltage and the second residual DC voltage is in a range of about 45 mV to about 90 mV.

15. The display apparatus of claim 14, wherein the black voltage signal is reset based on a black offset, the black offset being in a range of about 45 mV to about 90 mV.

16. The display apparatus of claim 13, the display panel comprising:

a first substrate;

a common electrode on the first substrate;

a pixel electrode on the common electrode, the pixel electrode overlapping the common electrode;

a second substrate facing the first substrate; and a liquid crystal layer between the first and second substrates.

17. The display apparatus of claim 16, further comprising:

a first alignment layer on the first substrate; and a second alignment layer on the second substrate.

18. The display apparatus of claim 17, wherein the first and second alignment layers are photoalignment layers.

19. The display apparatus of claim 16, wherein the liquid crystal layer comprises a liquid crystal having negative dielectric anisotropy.

20. The display apparatus of claim 19, wherein the liquid crystal layer further comprises hindered amine light stabilizer (HALS).

* * * * *